US007382392B2

(12) United States Patent
Yoo et al.

(10) Patent No.: US 7,382,392 B2
(45) Date of Patent: Jun. 3, 2008

(54) METHOD AND APPARATUS FOR COMPENSATING FOR SCANNING SKEW

(75) Inventors: Sang-Hun Yoo, Seongnam-Si (KR); Beom-Ro Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 202 days.

(21) Appl. No.: 11/184,777

(22) Filed: Jul. 20, 2005

(65) Prior Publication Data

US 2006/0017802 A1 Jan. 26, 2006

(30) Foreign Application Priority Data

Jul. 20, 2004 (KR) ..... 10-2004-0056169
Dec. 11, 2004 (KR) ..... 10-2004-0104613

(51) Int. Cl.
*B41J 2/435* (2006.01)
*B41J 2/47* (2006.01)

(52) U.S. Cl. ..... 347/248; 347/234

(58) Field of Classification Search ..... 347/248, 347/234

See application file for complete search history.

(56) References Cited

U.S. PATENT DOCUMENTS 6,118,463 A * 9/2000 Houki et al. ..... 347/116
6,359,640 B1 * 3/2002 Ravitz et al. ..... 347/234
6,757,075 B1 * 6/2004 Takemoto ..... 358/1.7
6,934,049 B1 * 8/2005 Yamada ..... 358/1.16
2003/0106448 A1 * 6/2003 Uemura ..... 101/477
2004/0095618 A1 * 5/2004 Palmon et al. ..... 358/486
2006/0017795 A1 * 1/2006 Nomura et al. ..... 347/232

FOREIGN PATENT DOCUMENTS

JP 11-042803 2/1999
JP 2000-280525 10/2000
JP 2001-038964 2/2001
JP 2002-333755 11/2002
JP 2003-226039 8/2003

* cited by examiner

*Primary Examiner*—Hai C Pham
*Assistant Examiner*—Kainoa B Wright
(74) *Attorney, Agent, or Firm*—Roylance, Abrams, Berdo & Goodman, L.L.P.

(57) ABSTRACT

A method and apparatus for compensating for scanning skew formed in an electrophotographic color image forming device. The method includes the step of making a scanning light that forms a scanning line ascend or descend in a sub-scanning direction within a range of one dot, and scanning the ascending or descending light in the main scanning direction. Also, the apparatus includes an optical scanner control unit which controls an optical scanning unit so that a scanning light that forms a scanning line ascends or descends in a sub-scanning direction within a range of one dot and the ascending or descending light is scanned in the main scanning direction.

12 Claims, 13 Drawing Sheets

X: MAIN SCANNING DIRECTION
Y: SUB-SCANNING DIRECTION

METHOD AND APPARATUS FOR COMPENSATING FOR SCANNING SKEW

CROSS-REFERENCE TO RELATED APPLICATIONS

This application claims benefit under 35 U.S.C. § 119 from Korean Patent Application Nos. 2004-56169 and 2004-104613, filed on Jul. 20, 2004 and Dec. 11, 2004, respectively, the entire disclosures of which are hereby incorporated by reference.

BACKGROUND OF THE INVENTION

1. Field of the Invention

The present invention relates generally to an electrophotographic image forming device. More particularly, the present invention relates to a method and apparatus for compensating for scanning skew formed on a photosensitive medium through an optical scanning operation.

2. Description of the Related Art

In general, an electrophotographic image forming device such as a laser printer or a digital copy machine, forms image data input from a computer or a scanner onto a printing medium such as printing paper through a series of image forming processes. The image forming processes of the electrophotographic image forming device include processes of charging, writing, developing, transferring and fusing.

The electrophotographic image forming device may be divided into a controller and an engine. The controller analyzes and stores image data sent from a computer to a memory of the printer, communicates with the engine so that the engine can perform the image forming, and then transmits the data stored in the memory in the form of serial data. The engine includes mechanical elements that print the image data transmitted from the controller onto the printing paper. In the case of a laser printer, the main elements of the engine include at least an organic photoconductive drum (hereinafter referred to as a "photoconductive drum"), an optical scanner, and a developer.

FIG. 1 is a view illustrating the construction of an engine of an electrophotographic image forming device. The image forming device 100 is a color image forming device that can print a color image.

Referring to FIG. 1, the color image forming device 100 is provided with a first developer 110 that contains yellow (Y) toner, a second developer 120 that contains cyan (C) toner, a third developer 130 that contains magenta (M) toner, and a fourth developer 140 that contains black (K) toner. The color image forming device 100 is also provided with two photoconductive drums 157 and 167, a pair of optical scanners 159 and 169, and an intermediate transfer belt 170. All of the above-described constituent elements are provided inside a case 101 of the device 100.

The photoconductive drums 157 and 167 are exposed to light that the optical scanners 159 and 169 will scan to form electrostatic latent images. The first photoconductive drum 157, that is the upper one between the pair of photoconductive drums, is charged by a first charging roller 155, and is adjacent to the first and second developers 110 and 120 so that it can receive yellow (Y) toner and cyan (C) toner from the first and second developers to develop an image. The second photoconductive drum 167, that is the lower one between the pair of photoconductive drums, is charged by a second charging roller 165, and is adjacent to the third and fourth developers 130 and 140 so that it can receive magenta (M) toner and black (K) toner from the third and fourth developers to develop an image.

The intermediate transfer belt 170 is rotatably supported by a belt driving roller 171 that is connected to a motor shaft (not illustrated), a transfer backup roller 172 that is preferably an idle roller, and first and second support rollers 173 and 174 that are also idle rollers. As illustrated, the transfer belt 170 and rotates clockwise. First and second transfer rollers 175 and 176, provided inside the intermediate transfer belt 170, are arranged opposite to the first and second photoconductive media 157 and 167, respectively, with the intermediate transfer belt 170 being interposed between the first and second transfer rollers and the first and second photoconductive media.

A third transfer roller 180 is provided under the transfer backup roller 172 and is arranged opposite to the transfer backup roller 172 with the intermediate transfer belt 170 being interposed between the third transfer roller and the transfer backup roller.

Additionally, the electrophotographic image forming device 100 is provided with a fuser 185 for fusing a color image transferred onto a printing paper P by heat and pressure. Also provided is a feeder cassette 105 for loading the printing papers P, a pickup roller 182 for picking up the printing papers from the feeder cassette 105 paper by paper, a sorter 184 for sorting and conveying the picked printing papers, and first to third discharge rollers 186, 187 and 188 for discharging the printing paper P on which the color image is printed to the outside of the case 101.

The color image forming device 100 forms a color image in a manner that it transfers yellow (Y), magenta (M), cyan (C) and black (K) images onto the intermediate transfer belt 170 by superimposition to form a color image on the intermediate transfer belt 170. The color image forming device 100 then transfers and fuses the color image onto the printing paper P.

If light corresponding to yellow (Y) image information is scanned from the first optical scanner 159 to the first photoconductive drum 157 that is charged with uniform potential, a part of the drum on which the light is scanned comes to have a reduced resistance, and this causes charges attached to the outer peripheral surface of the first photoconductive drum 157 to escape from the outer peripheral surface of the drum 157. Accordingly, a potential difference occurs between the scanned part and the remaining part, and this causes an electrostatic latent image to be formed on the outer peripheral surface of the first photoconductive drum 157 being rotated. In this case, a yellow (Y) electrostatic latent image is developed as the yellow (Y) toner is supplied from the first developer 110 to the first photoconductive drum 157, and then a yellow (Y) image is transferred to the intermediate transfer belt 170 as the first photoconductive drum 157 is rotating.

Additionally, on the intermediate transfer belt 170, a magenta (M) image from the second photoconductive drum 167 is transferred and superimposed in the same manner as the transfer of the yellow (Y) image. After one-period of circulation on the intermediate transfer belt 170, a cyan (C) image from the first photoconductive drum 157 and a black (K) image from the second photoconductive drum 167 are transferred and superimposed in turn to form a color image.

Meanwhile, the printing papers P, loaded in the feeder cassette 182, are picked up by the pickup roller 182 for sorting by the sorter 184, and then pass through the third transfer roller 180 and the intermediate transfer belt 170. Thus, the color image is transferred onto the printing paper P. The color image transferred onto the printing paper P is then fused on the printing paper P by heat and pressure applied from the fuser 185, and the printing paper P on which the color image is fused is discharged to a discharge tray 102 provided outside the case 101 by the discharge rollers 186, 187 and 188.

FIG. 2 is a perspective view schematically illustrating the structure of the first optical scanner 159. FIG. 3 is a view illustrating side and center feeding of printing paper.

Referring to FIG. 2, the first optical scanner 159 is composed of a laser diode 200, a polygon mirror 204, a driver 202 and a reflecting mirror 206.

The laser diode 200 emits light. The driver 202 is a motor for rotating the polygon mirror 204 at a constant speed. The polygon mirror 204 scans the linear light irradiated from the laser diode 200 corresponding to the image signal. The reflecting mirror 206 reflects an incident light in a specified direction so that the reflected light is incident to the surface of the first photoconductive drum 157 on which the image is formed. Meanwhile, the second optical scanner 169 has substantially the same construction as the first optical scanner 159 as described above. Accordingly, a detailed description thereof is omitted for clarity and conciseness.

As the polygon mirror 204 rotates, the light emitted from the laser diode 200 is incident to an area drawn from a point "a" to a point "b" on the first photoconductive drum 157. Hereinafter, the area configured from the point "a" to the point "b" is called an optical scanning area. Generally, in performing the image printing work, the electrophotographic image forming device does not use the whole optical scanning area of the photoconductive area, but, uses only a reduced part thereof. This will now be explained with reference to FIG. 3.

The paper feeding process is classified into a center feeding process and a side feeding process. The center feeding process makes a center part of the printing paper pass through a center part c of the optical scanning area, and the side feeding process makes the printing paper pass through the optical scanning area as the printing paper slants to the left. In FIG. 3, the printing paper P1 indicates the printing paper fed by the center feeding process, and the printing paper P2 indicates the printing paper fed by the side feeding process.

An inclination of a scanning line formed in the optical scanning area of the photoconductive drum due to an optical scanning of the optical scanner is defined as a skew. This skew may occur due to a dimensional error of the optical scanner or the photoconductive drum. In forming the color image, four colors are superimposed. If directions and degrees of skews of plural scanning lines are different from one another, although the scanning lines have the skews that are within an allowable error range, the color image formed by the image superimposition may deteriorate in quality. Accordingly, skew compensation that makes the skews of the scanning lines of the respective colors coincide with one another in a specified allowable error range is required.

FIGS. 4A to 4C are views explaining a conventional method for compensating for a scanning skew performed in the color image forming device of FIG. 1. Since the color image forming device 100 illustrated in FIG. 1 is provided with a pair of optical scanners 159 and 169 and a pair of photoconductive drums 157 and 167, the skew of the scanning line scanned by one optical scanner is compensated for on the basis of the scanning line scanned by the other optical scanner. Hereinafter, it is assumed that the scanning line formed on the second photoconductive drum 167, by the optical scanning of the second optical scanner 169 (hereinafter referred to as a "second scanning line"), is compensated for on the basis of the scanning line formed on the first photoconductive drum 157 by the optical scanning of the first optical scanner 159.

Referring to FIG. 4A, although the first scanning line and the second scanning line should be superimposed without any skew, a skew of one dot occurs through the optical scanning area. In order to compensate for the one-dot skew, the optical scanning area is divided into two, and the second optical scanner 169 emits light that ascends by one dot in the right area. Referring to FIG. 4B, a skew of two dots occurs between the first scanning line and the second scanning line. In order to compensate for this, the optical scanning area is divided into three, and the second optical scanner 169 emits light that ascends by one dot in the second area and emits light that ascends by two dots in the third area. Referring to FIG. 4C, a skew of three dots occurs between the first scanning line and the second scanning line. In order to compensate for this, the optical scanning area is divided into four, and the second optical scanner 169 emits light that ascends by one dot in the second area, emits light that ascends by two dots in the third area, and emits light that ascends by three dots in the fourth area.

The conventional method for compensating for scanning skew as described above; however, has problems in that defects of the printed image due to discontinuation of the second scanning line on the boundaries of the divided optical scanning areas are relatively easily visible to the human eye. Particularly, if the skew of odd-numbered dots occurs with respect to the printing paper fed by the center feeding process, the discontinuation of the scanning line appears on the center part of the printing paper, while if the skew of even-numbered dots occurs with respect to the printing paper fed by the side feeding process, the discontinuation of the scanning line also appears on the center part of the printing paper. Thus, print defects that are much more noticeable result.

Accordingly, there is a need for an improved electrophotographic color image forming device which compensates for scanning skew formed in an electrophotographic color image forming device.

SUMMARY OF THE INVENTION

An aspect of the present invention is to solve at least the above problems and/or disadvantages and to provide at least the advantages described below. Accordingly, an aspect of the present invention is to provide a method and apparatus for compensating for a scanning skew formed in an electrophotographic color image forming device.

Another aspect of the present invention is to provide a method and apparatus for compensating for a scanning skew that can prevent the discontinuation of an image from occurring on the center part of a printing paper during an image printing operation.

The foregoing and other objects and advantages are substantially realized by providing a method for compensating for a scanning skew occurring in an electrophotographic image forming device using a center feeding process. The method comprising the steps of dividing an area in which an image forming is possible into a plurality of areas so that a center part of the area in which the image forming is possible is not discontinued. Performing the image forming using image forming signals having different lines in accordance with the divided areas.

If the occurring skew is of one dot, the skew is preferably not compensated for.

If the occurring skew is of at least two dots, the area in which the image forming is possible may be divided according to Equation (1), If the occurring skew is in a range of 2n to 2n+1:
Dividing the area into 2n+1 areas (1)

wherein 'n' denotes a natural number that is larger than '1'.

When the area in which the image forming is possible is divided into the plurality of areas, the center part of the area may be determined to be wider than the other parts.

When the image forming signals are transferred to the plurality of divided areas, the image forming signals having a difference of one dot in an upper/lower direction may be transferred to the adjacent areas, respectively.

The image forming device may be a color laser printer.

According to another aspect of the present invention, an apparatus for compensating for a scanning skew occurring in an electrophotographic image forming device using a center feeding process, comprises an optical scanner control unit for dividing an area in which an image forming is possible into a plurality of areas so that a center part of the area in which the image forming is possible is not discontinued. An image signal processing unit performs the image forming using image forming signals having different lines in accordance with the divided areas.

A skew measurement unit may be further provided which measures whether the skew occurs according to a control command of the optical scanner control unit.

If the occurring skew is of at least two dots, the optical scanner control unit may divide the area in which the image forming is possible according to Equation (2), If the occurring skew is in a range of 2n to 2n+1:
Dividing the area into 2n+1 areas (2)

wherein 'n' denotes a natural number that is larger than '1'.

When the area in which the image forming is possible is divided into the plurality of areas, the optical scanner control unit may determine the center part of the area to be wider than the other parts.

When the image forming signals are transferred to the plurality of divided areas, the image signal processing unit may transfer the image forming signals having a difference of one dot in an upper/lower direction to the adjacent areas, respectively.

The image forming device is preferably a color laser printer.

According to yet another aspect of the present invention, a method is provided for compensating for scanning skew formed by an optical scanner's scanning of light in a main scanning direction in an electrophotographic image forming device, which comprises the step of making the scanning light that forms a scanning line ascend or descend in a sub-scanning direction within a range of one dot, and scanning the ascending or descending light in the main scanning direction.

Preferably, the method for compensating for scanning skew may further comprises the steps of dividing the original image signal of one line that forms the scanning line into a plurality of areas and forming a combined image signal by modulating the original image signal so that the image signals of the divided adjacent areas have a one-dot difference by stages in the sub-scanning direction, and transferring the combined image signal to the optical scanner.

Preferably, if a size of the skew of the scanning line that is indicated as the number of dots is 'S', with respect to a printing paper fed by a center feeding process, it may be defined that $2n-1<S\leqq 2n+1$, wherein 'n' denotes a natural number that is larger than '1', and the number of divided areas of the original image signal may be 2n+1.

Preferably, if a size of the skew of the scanning line that is indicated as the number of dots is 'S', with respect to a printing paper fed by a side feeding process, it may be defined that $2n-1\leqq S<2n+1$, wherein 'n' denotes a natural number that is larger than '1', and the number of divided areas of the original image signal may be 2n+1.

According to another aspect of the present invention, there is provided an apparatus for compensating for scanning skew formed by an optical scanner's scanning of light in a main scanning direction in an electrophotographic image forming device, which comprises an optical scanner control unit which controls the optical scanning unit so that the scanning light that forms a scanning line ascends or descends in a sub-scanning direction within a range of one dot and the ascending or descending light is scanned in the main scanning direction.

Other objects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other objects, features, and advantages of certain embodiments of the present invention will be more apparent from the following description taken in conjunction with the accompanying drawings, in which:

FIG. 6 illustrates a case that printing paper is fed by a center feeding process while FIG. 7 illustrates a case in which printing paper is fed by a side feeding process; FIGS. 8A to 8D illustrate a case in which printing paper is fed by a center feeding process, while FIGS. 9A to 9D illustrate a case in which printing paper is fed by a side feeding process.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
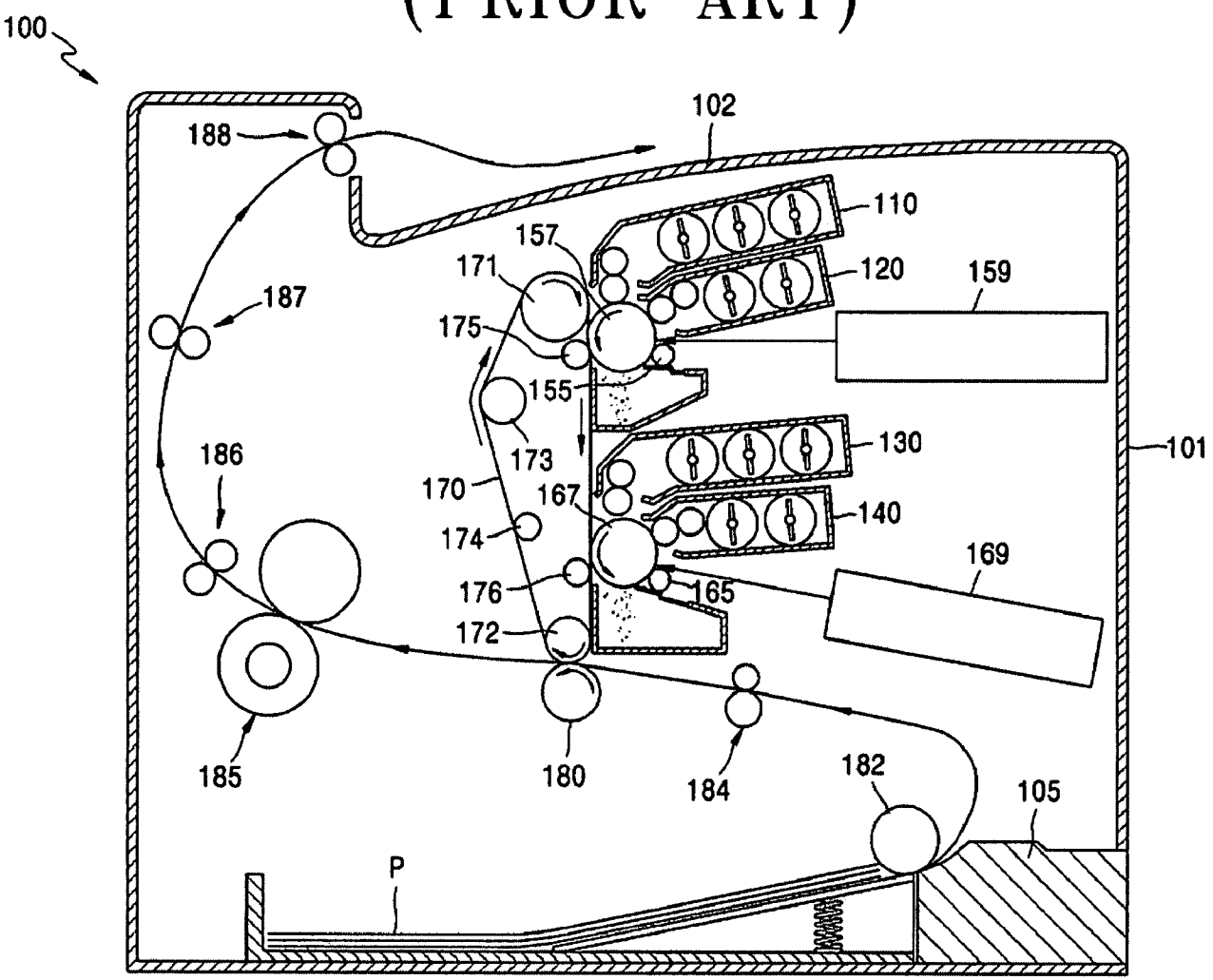
FIG. 1 (PRIOR ART)
FIG. 1 is a view illustrating the construction of an engine of an electrophotographic image forming device.

According to the skew compensation method and apparatus according to exemplary embodiments of the present invention, the second scanning line formed on the second photoconductive drum 167 by the optical scanning of the second optical scanner 169 of the color image forming device 100 illustrated in FIG. 1 is made to coincide with the first scanning line formed on the first photoconductive drum 157 by the optical scanning of the first optical scanner 159 within a specified allowable error range.

Figure 5:
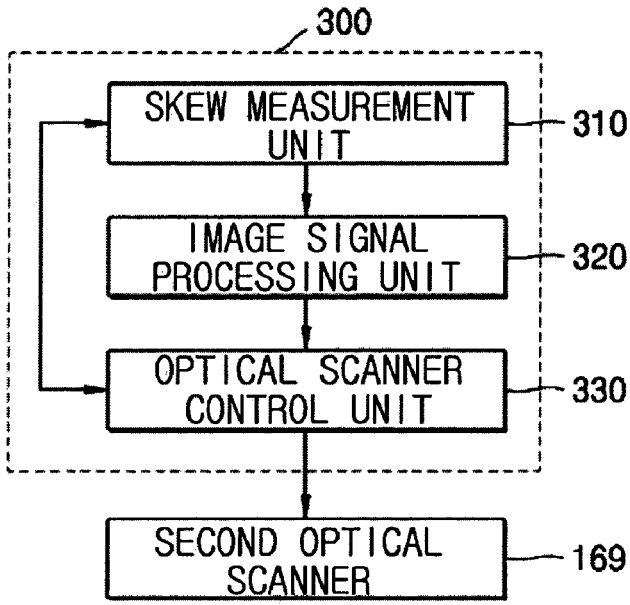
FIG. 5 is a block diagram illustrating the construction of a skew compensation apparatus according to an exemplary embodiment of the present invention.
Figure 6:
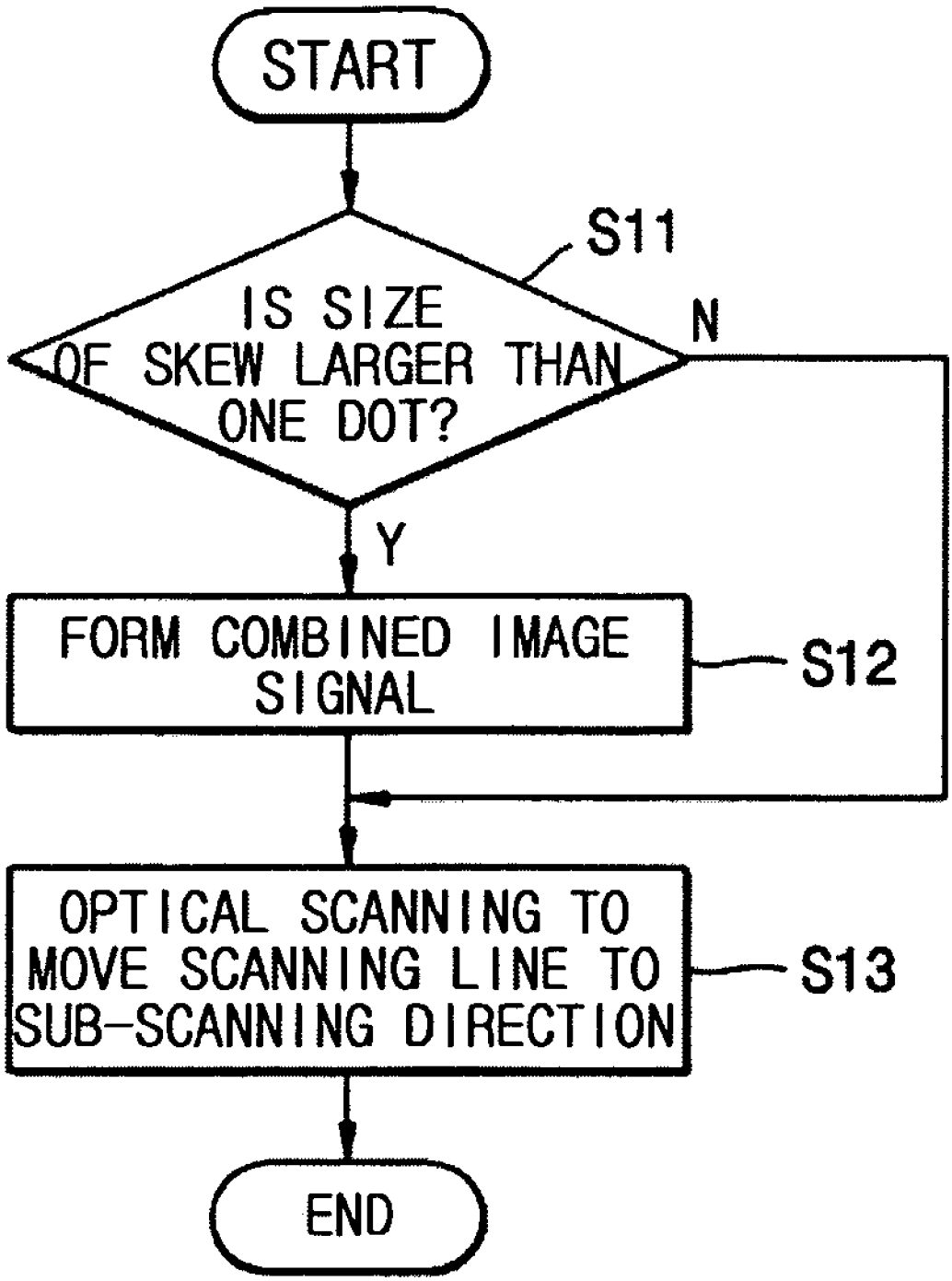
FIGS. 6 and 7 are flowcharts illustrating a skew compensation method according to an exemplary embodiment of the present invention, and particularly.
Figure 7:
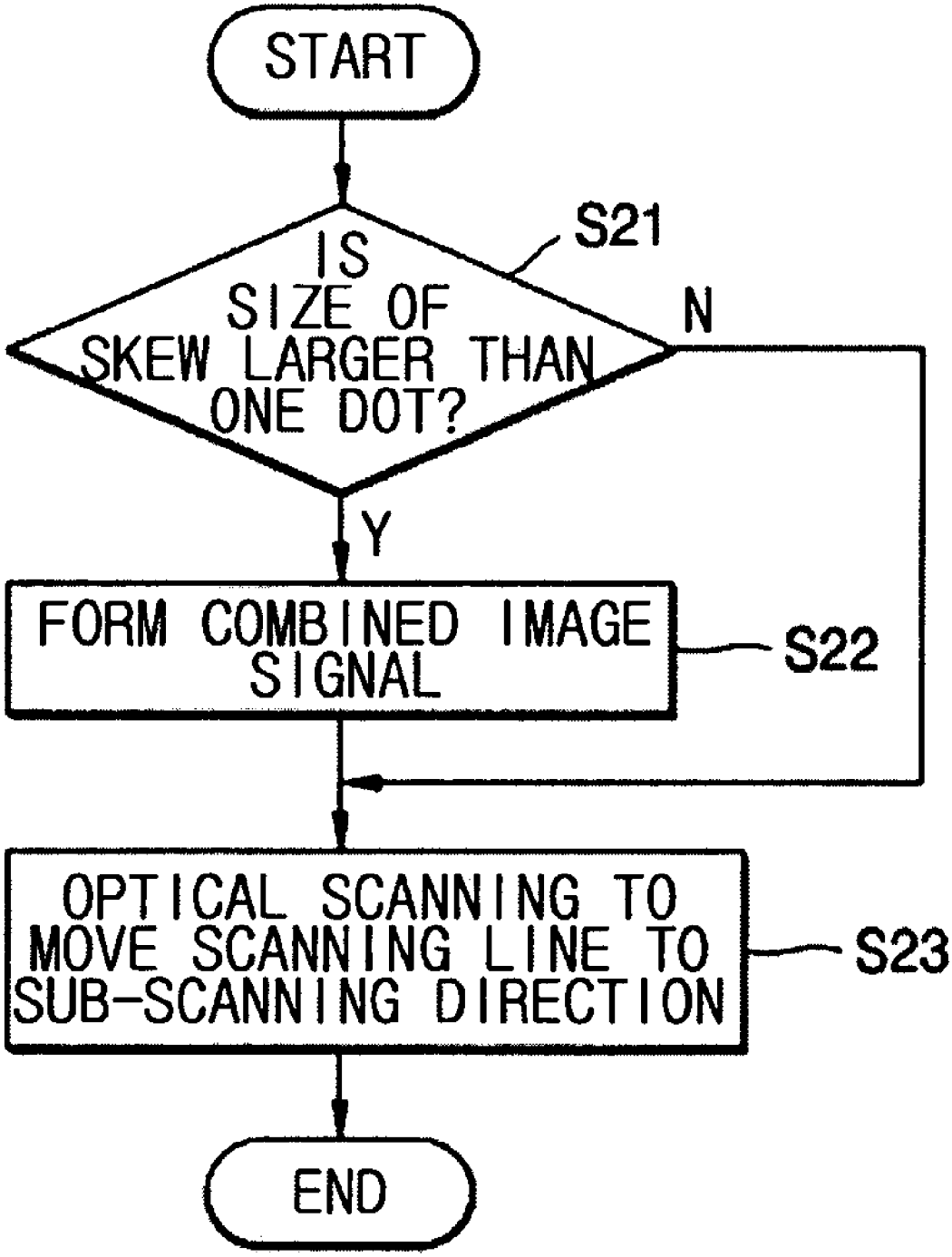

FIG. 5 is a block diagram illustrating the construction of a skew compensation apparatus according to a exemplary embodiment of the present invention. FIGS. 6 and 7 are flowcharts illustrating a skew compensation method according to an exemplary embodiment of the present invention. In particular, FIG. 6 illustrates a case in which printing paper is fed by a center feeding process, and FIG. 7 illustrates a case in which printing paper is fed by a side feeding process. FIGS. 8A to 8D and 9A to 9D are views illustrating a skew compensation process according to an exemplary embodiment of the present invention. Particularly, FIGS. 8A to 8D illustrate a case in which printing paper is fed by a center feeding process, and FIGS. 9A to 9D illustrate a case in which printing paper is fed by a side feeding process.

Referring to FIG. 5, a skew compensation apparatus 300 includes a skew measurement unit 310, an image signal processing unit 320 and an optical scanner control unit 330. The skew measurement unit 310 measures a skew of a second scanning line with respect to a first scanning line, and stores the size of the skew. The image signal processing unit 320 forms four kinds of image signals corresponding to an image of four colors, that is, yellow (Y), cyan (c), magenta (M) and black (K), so that the color image can be printed by a color superimposition.

More particularly, the image signal processing unit 320 reads the size of the skew from the skew measurement unit 310, and modulates the original image signal corresponding to the second scanning line accordingly to form a combined image signal. The optical scanner control unit 330 receives the combined image signal, and controls the second optical scanner 169 to scan the corresponding light onto the second photoconductive drum 167. For a more accurate skew compensation, the optical scanner control unit 330 controls the second optical scanner 169 to make the scanning light ascend or descend in a sub-scanning direction within a range of one dot and to scan the ascending or descending light onto the second photoconductive drum 167.

Referring to FIG. 6, in the case in which the printing paper is fed by a center feeding process in the color image forming device 100, the skew compensation method is performed as follows.

It is judged whether the size of the skew in the optical scanning area is larger than one dot (step S11). The size of the skew is measured by the skew measurement unit 310 (See FIG. 5). If the size of the skew is larger than one dot, the original image signal corresponding to the second scanning line is modulated by the image signal processing unit 320 to form the combined image signal (step S12).

The combined image signal is made by dividing the original image signal into a plurality of areas and modulating the original image signal so that image signals of the divided adjacent areas have a one-dot difference by stages in the sub-scanning direction. If the size of the skew that is indicated as the number of dots is 'S' and it is determined that $2n-1<S\leqq 2n+1$ in the case in which the printing paper is fed by the center feeding process, the number of divided areas of the original image signal is determined as 2n+1. Here, n is a natural number. For example, if 'S' corresponds to one dot, the original image signal is not divided. If 'S' corresponds to two or three dots, the original image signal is divided into three equally distant areas. If 'S' corresponds to four or five dots, the original image signal is divided into five equally distant areas. Accordingly, no image discontinuation due to the area division is formed on the center part of the printing paper, and thus the print quality is improved.

Figure 2:
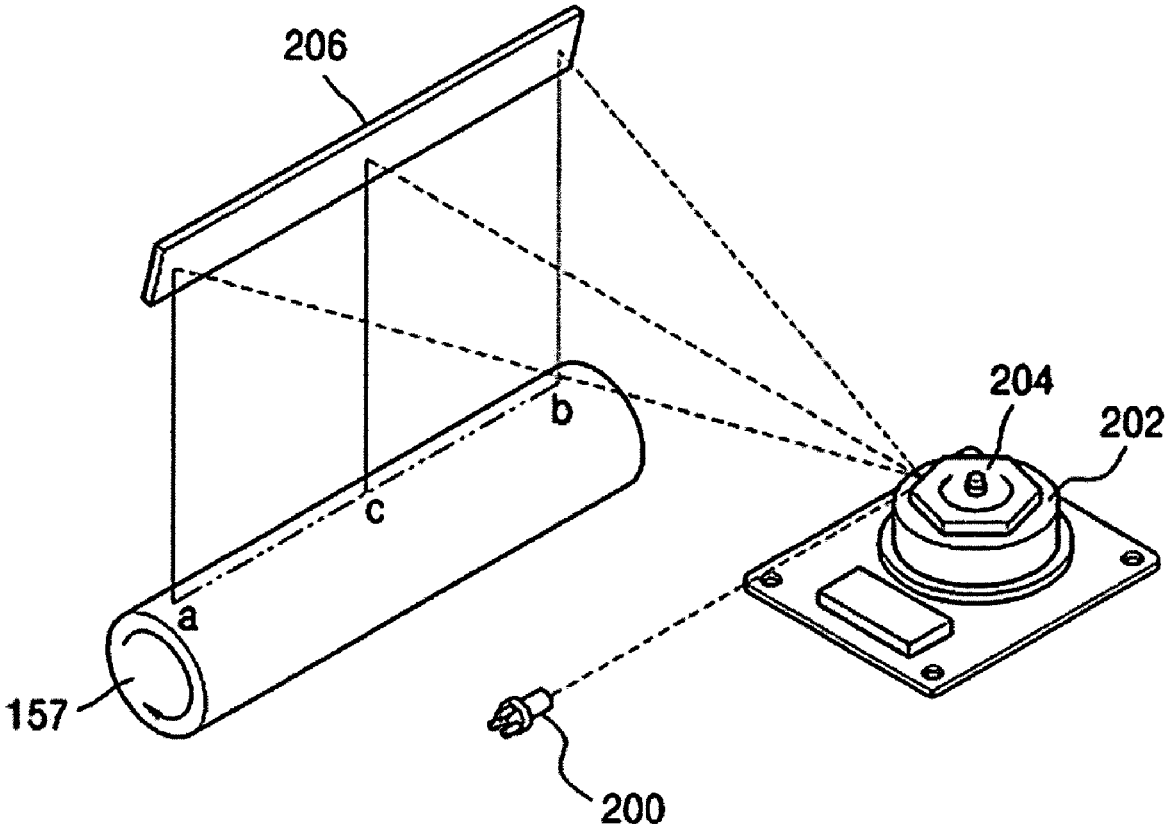
FIG. 2 (PRIOR ART)
FIG. 2 is a perspective view schematically illustrating the structure of the first optical scanner of FIG. 1.
Figure 3:
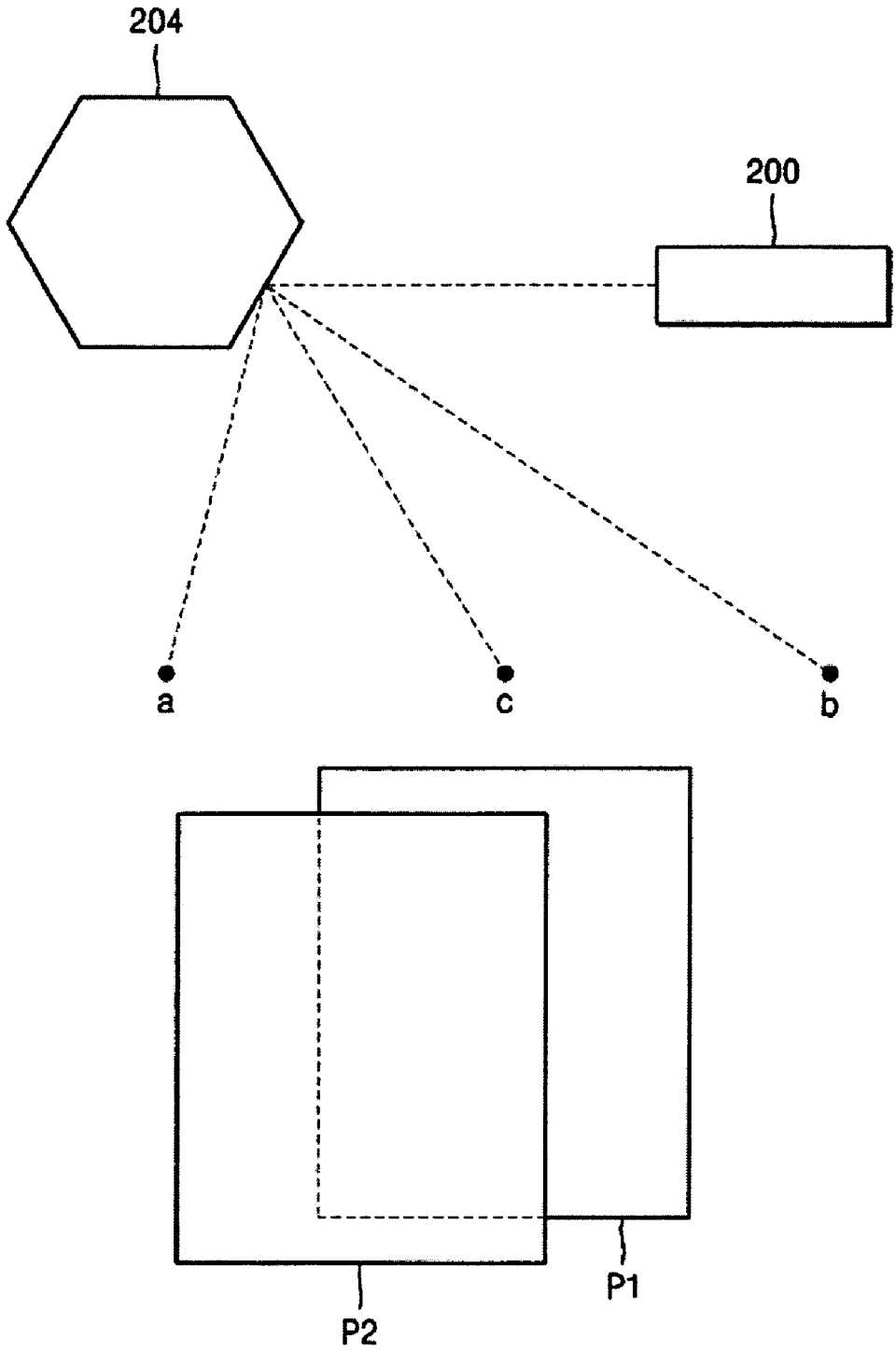
FIG. 3 (PRIOR ART)
FIG. 3 is a view illustrating side and center feeding of printing paper.
Figure 4A:
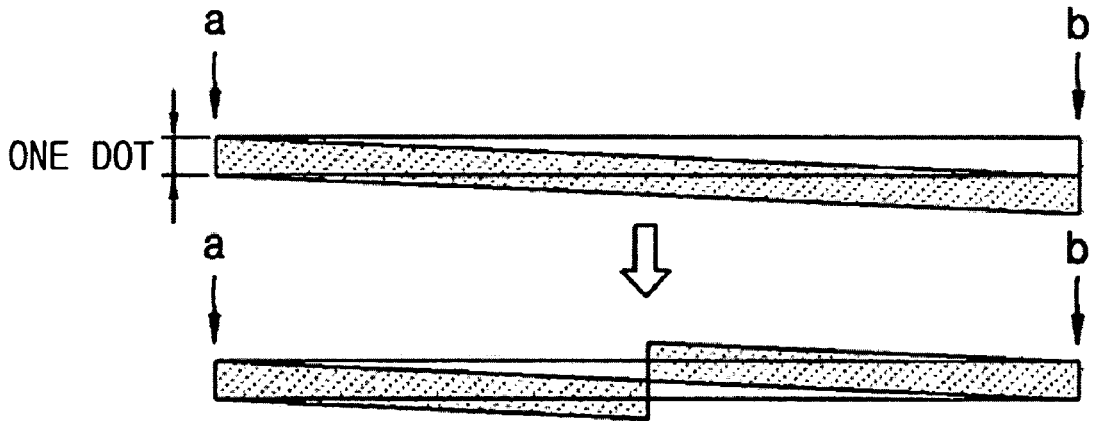
FIG. 4A (PRIOR ART)
FIGS. 4A to 4C are views explaining a conventional method for compensating for a scanning skew.
Figure 4B:
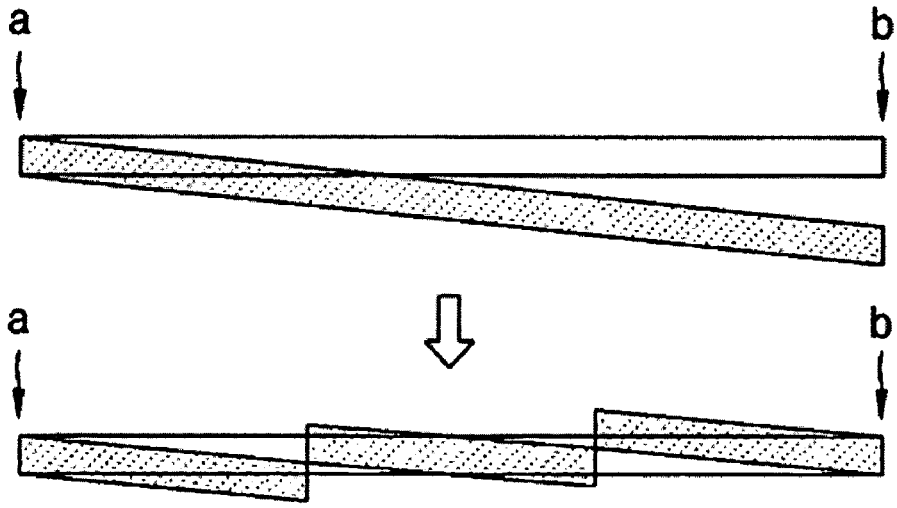
FIG. 4B (PRIOR ART)
Figure 4C:
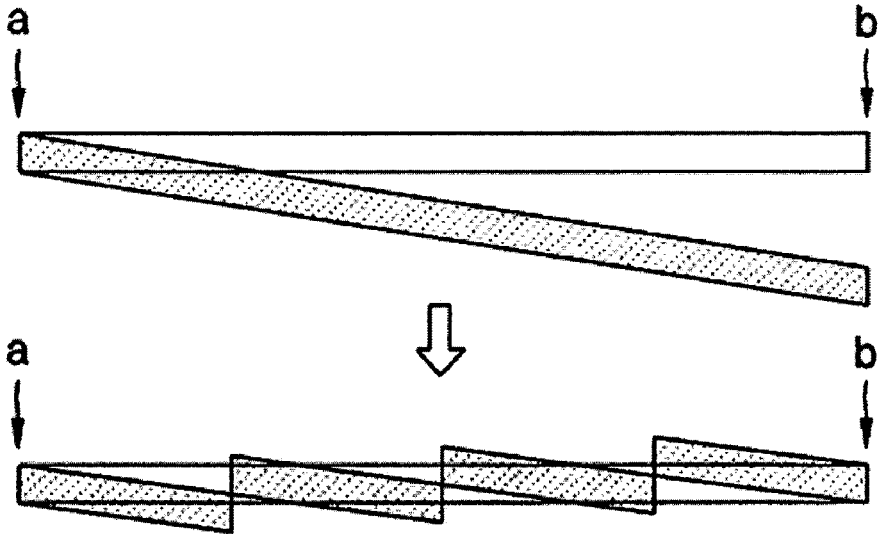
FIG. 4C (PRIOR ART)

The combined image signal is transmitted to the optical scanner control unit 330, and the optical scanner control unit 330 (See FIG. 5) controls the second optical scanner 169 (See FIG. 5) so that the second scanning line ascends or descends in the sub-scanning direction within the range of one dot (S13). The degree of ascending/descending of the second optical scanning line in the sub-scanning direction corresponds to half of the size of the skew occurring when the light is scanned without any ascending. The second scanning line can be scanned after it ascends/descends in the sub-scanning direction through diverse methods. For example, the laser diode 200 (See FIG. 2) may accelerate or delay the prearranged optical scanning time, and the polygon mirror 204 (See FIG. 2) may synchronize the optical scanning. For this, the image signal input to the laser diode 200 may be accelerated or delayed.

Hereinafter, a skew compensation method in the case in which the printing paper is fed by the center feeding process will be explained with reference to FIGS. 8A through 8D.

Figure 8A:
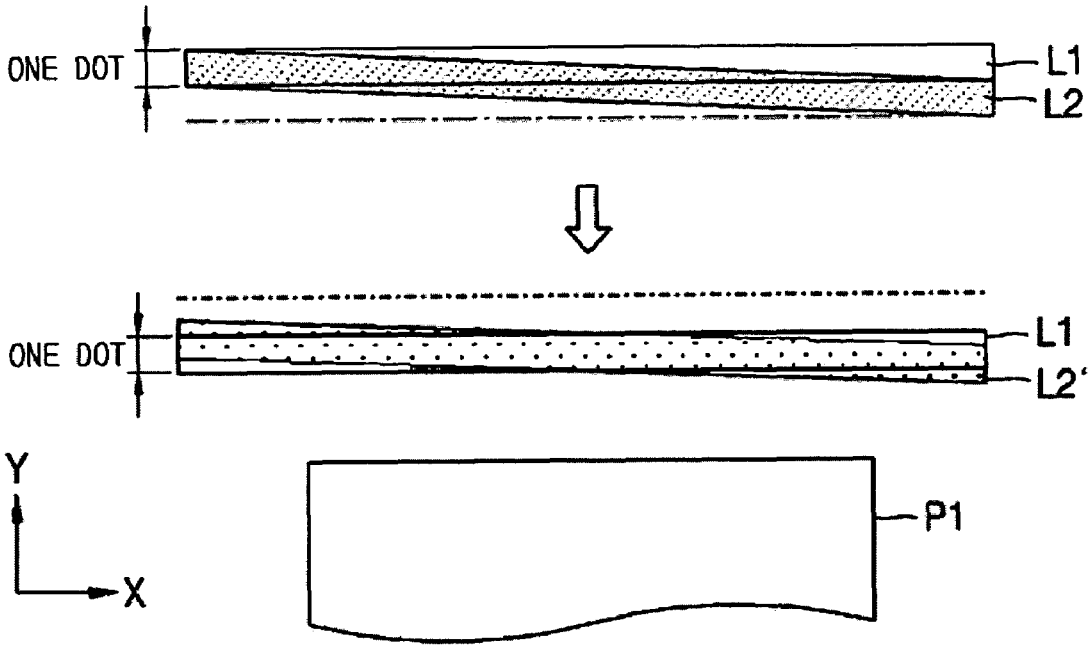
FIGS. 8A to 8D and 9A to 9D are views illustrating a skew compensation process according to an exemplary embodiment of the present invention, and particularly.

Referring to FIG. 8A, a descending skew of one dot occurs in the second scanning line L2 in comparison to the first scanning line L1. Since the size of the skew is not larger than '1', the original image signal for the second scanning line L2 is not modulated to a combined image signal, but, the second optical scanner 169 (See FIG. 5) is controlled to make the scanning light ascend in the sub-scanning direction X by 0.5 dot. Accordingly, the superimposition part of the first scanning line L1 and the modified second scanning line L2' is larger than that obtained according to the conventional method, and thus the quality of the color image printed on the printing paper P1 is improved.

Figure 8B:
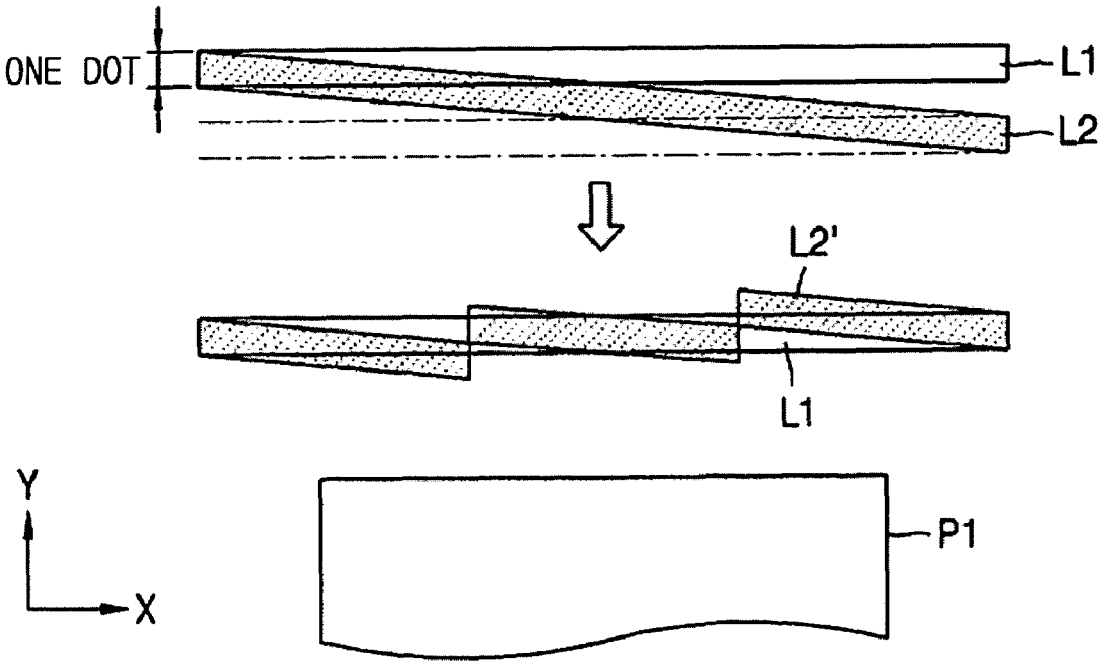

Referring to FIG. 8B, a descending skew of two dots occurs in the second scanning line L2 in comparison to the first scanning line L1. Since the size of the skew is larger than '1', the original image signal for the second scanning line L2 is modulated to a combined image signal. Specifically, since the size of the skew is larger than one dot but does not exceed three dots, the original image signal is divided into three areas. That is, the original image signal in the second area that follows the first area on the left side is arranged to ascend by one dot in the sub-scanning direction Y. Additionally, the original image signal in the third area is arranged to ascend by two dots in the sub-scanning direction Y. Accordingly, at the right end of the optical scanning area, no skew occurs between the modulated second scanning line L2', that corresponds to the combined image signal as modulated above, and the first scanning line L1. Thus, it is not required to control the second optical scanner 169 to make the scanning light ascend/descend by a specified length in the sub-scanning direction Y. If the printing paper P1 is fed by the center feeding process in the skew-compensated color image forming device, the superimposition part of the first scanning line L1 and the second scanning line L2' is larger than that obtained in the case in which no skew compensation is performed. Consequently, the discontinuation caused by the area division of the scanning line occurs on a part other than the center part of the printing paper P1. Accordingly, the quality of the color image printed on the printing paper P1 is improved.

Figure 8C:
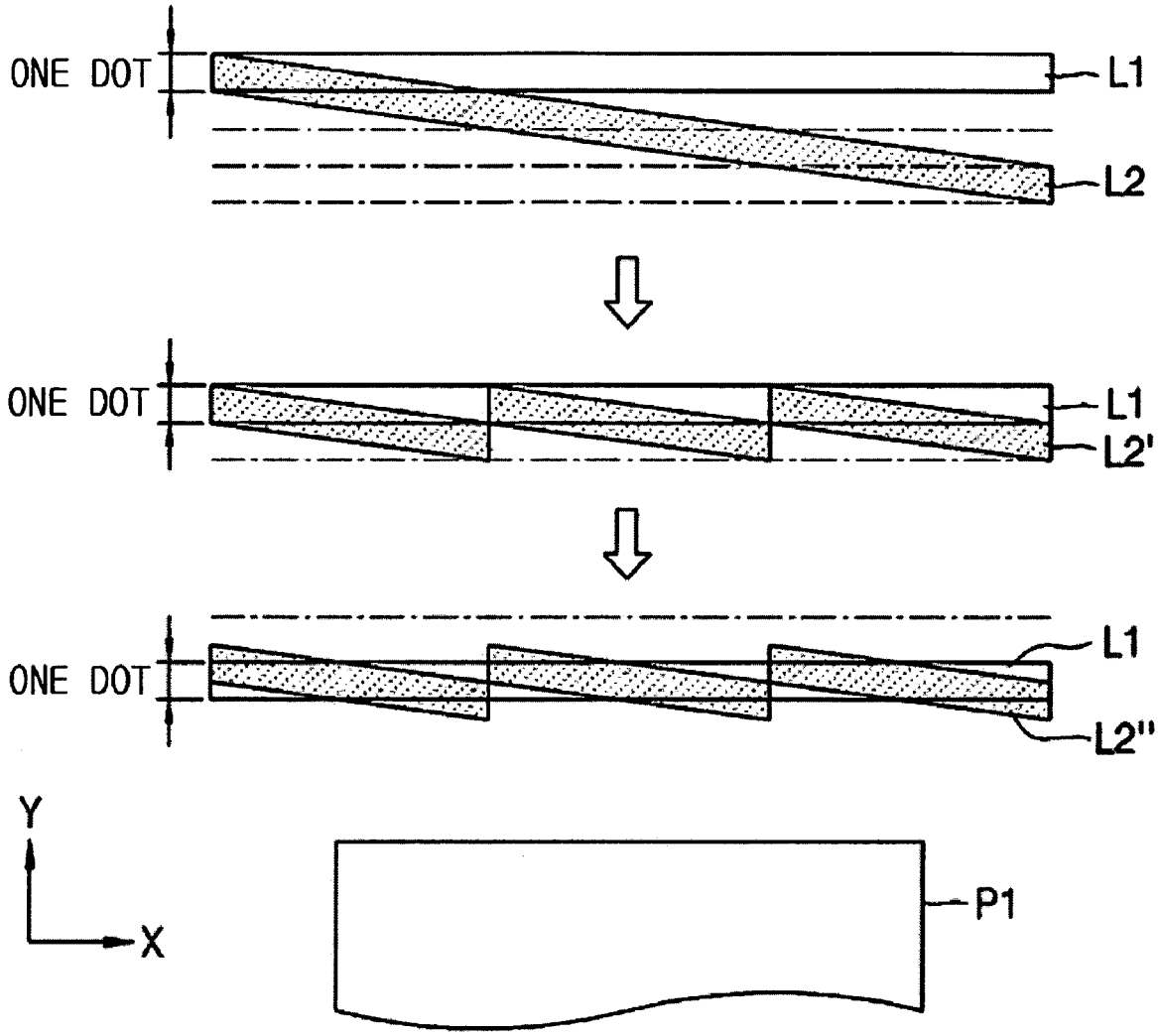

Referring to FIG. 8C, a descending skew of three dots occurs in the second scanning line L2 in comparison to the first scanning line L1. Since the size of the skew is larger than '1', the original image signal for the second scanning line L2 is modulated to a combined image signal. Specifically, since the size of the skew is larger than one dot, but, does not exceed three dots, the original image signal is divided into three areas. That is, the original image signal in the second area that follows the first area on the left side is arranged to ascend by one dot in the sub-scanning direction Y, and the original image signal in the third area is arranged to ascend by two dots in the sub-scanning direction Y. Accordingly, at the right end of the optical scanning area, a skew of one dot occurs between the modulated second scanning line L2' that corresponds to the combined image signal as modulated above and the first scanning line L1. Thus, the second optical scanner 169 is controlled to make the scanning light ascend by 0.5 dot in the sub-scanning direction Y. If the printing paper P1 is fed by the center feeding process in the skew-compensated color image forming device, the superimposition part of the first scanning line L1 and the finally compensated second scanning line L2" is larger than that obtained in the case in which no skew compensation is performed. Thus, the discontinuation caused by the area division of the scanning line occurs on a part other than the center part of the printing paper P1. Accordingly, the quality of the color image printed on the printing paper P1 is improved.

Figure 8D:
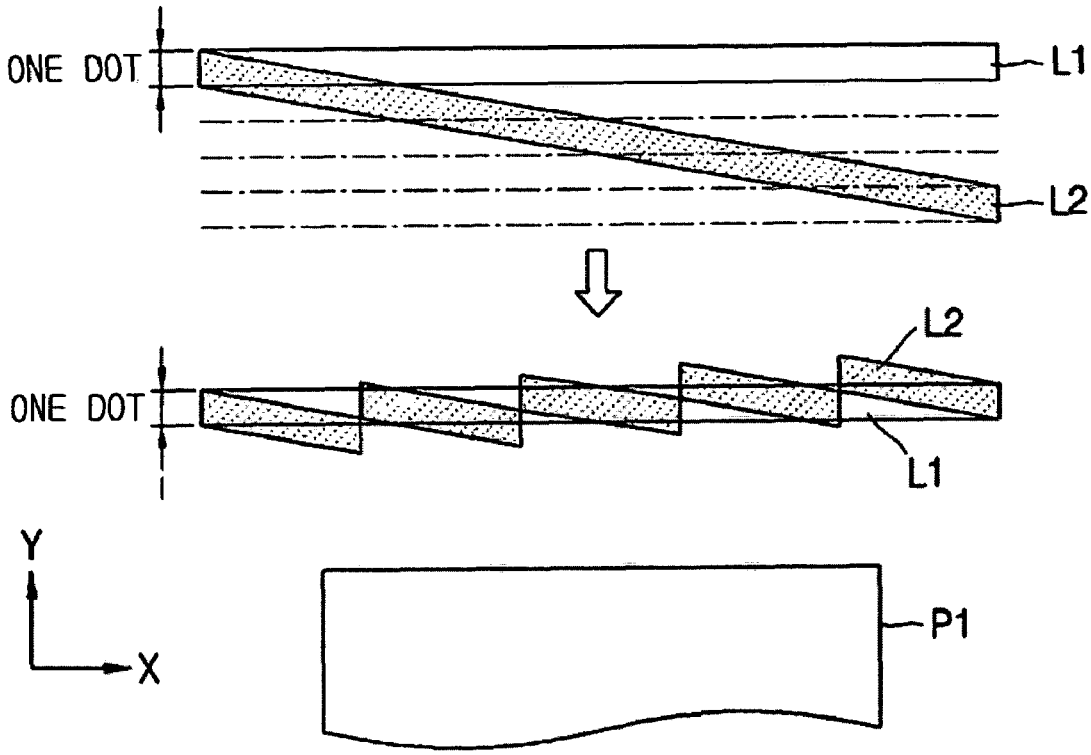

Referring to FIG. 8D, a descending skew of four dots occurs in the second scanning line L2 in comparison to the first scanning line L1. Since the size of the skew is larger than '1', the original image signal for the second scanning line L2 is modulated to a combined image signal. Specifically, since the size of the skew is larger than three dots, but, does not exceed five dots, the original image signal is divided into five areas. That is, the original image signal in the second area, that follows the first area on the left side, is arranged to ascend by one dot in the sub-scanning direction Y, and the original image signal in the third area is arranged to ascend by two dots in the sub-scanning direction Y. Also, the original image signal in the fourth area is arranged to ascend by three dots in the sub-scanning direction Y, and the original image signal in the fifth area is arranged to ascend by four dots in the sub-scanning direction Y. Accordingly, at the right end of the optical scanning area, no skew occurs between the modulated second scanning line L2', that corresponds to the combined image signal as modulated above, and the first scanning line L1. Thus, it is not required to control the second optical scanner 169 to make the scanning light ascend/descend by a specified length in the sub-scanning direction Y. If the printing paper P1 is fed by the center feeding process in the skew-compensated color image forming device, the superimposition part of the first scanning line L1 and the second scanning line L2', is larger than that obtained in the case in which no skew compensation is performed. Thus, the discontinuation caused by the area division of the scanning line occurs on a part other than the center part of the printing paper P1. Accordingly, the quality of the color image printed on the printing paper P1 is improved.

Referring to FIG. 7, in the case in which the printing paper is fed by a side feeding process in the color image forming device 100, the skew compensation method is performed as follows.

It is judged whether the size of the skew in the optical scanning area is not less than one dot (step S21). The size of the skew is measured by the skew measurement unit 310 (See FIG. 5). If the size of the skew is not less than one dot, the original image signal corresponding to the second scanning line is modulated by the image signal processing unit 320 to form the combined image signal (step S22).

The combined image signal is made by dividing the original image signal into a plurality of areas and modulating the original image signal so that image signals of the divided adjacent areas have a one-dot difference by stages in the sub-scanning direction. If the size of the skew that is indicated as the number of dots is 'S' and it is determined that $2n-1 \leqq S < 2n+1$ in the case in which the printing paper is fed by the side feeding process, the number of divided areas of the original image signal is determined as 2n. Here, n is a natural number. For example, if 'S' is smaller than one dot, the original image signal is not divided. If 'S' corresponds to one dot or two dots, the original image signal is divided into two equally distant areas. If 'S' corresponds to three or four dots, the original image signal is divided into four equally distant areas. Accordingly, no image discontinuation due to the area division is formed on the center part of the printing paper, and thus the print quality is improved.

The combined image signal is transmitted to the optical scanner control unit 330, and the optical scanner control unit 330 (See FIG. 5) controls the second optical scanner 169 (See FIG. 5) so that the second scanning line ascends or descends in the sub-scanning direction within the range of one dot (S23). The degree of ascending/descending of the second optical scanning line in the sub-scanning direction corresponds to half of the size of the skew occurring when the light is scanned without any ascending. The second scanning line can be scanned after it ascends/descends in the sub-scanning direction through diverse methods. For example, the laser diode 200 (See FIG. 2) may accelerate or delay the prearranged optical scanning time, and the polygon mirror 204 (See FIG. 2) may synchronize the optical scanning. For this, the image signal input to the laser diode 200 may be accelerated or delayed.

Hereinafter, a skew compensation method in the case in which the printing paper is fed by the side feeding process will be explained with reference to FIGS. 9A to 9D.

Figure 9A:
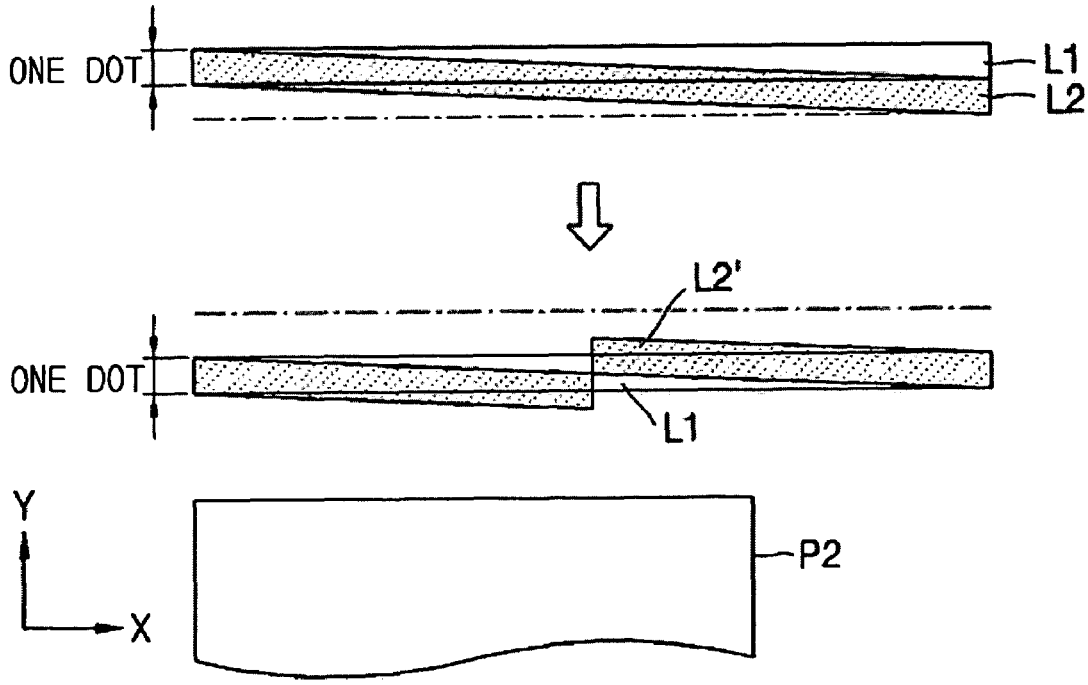

Referring to FIG. 9A, a descending skew of one dot occurs in the second scanning line L2 in comparison to the first scanning line L1. Since the size of the skew is not less than '1', the original image signal for the second scanning line L2 is modulated to a combined image signal. Specifically, since the size of the skew is not less than one dot, but, is less than three dots, the original image signal is divided into two areas. That is, the original image signal in the second area, that follows the first area on the left side, is arranged to ascend by one dot in the sub-scanning direction Y. Accordingly, at the right end of the optical scanning area, no skew occurs between the modulated second scanning line L2', that corresponds to the combined image signal as modulated above, and the first scanning line L1. Thus, it is not required to control the second optical scanner 169 to make the scanning light ascend/descend by a specified length in the sub-scanning direction Y. If the printing paper P2 is fed by the side feeding process in the skew-compensated color image forming device, the superimposition part of the first scanning line L1 and the second scanning line L2' is larger than that obtained in the case in which no skew compensation is performed. Consequently, the discontinuation caused by the area division of the scanning line occurs on a part other than the center part of the printing paper P2.

Accordingly, the quality of the color image printed on the printing paper P2 is improved.

Figure 9B:
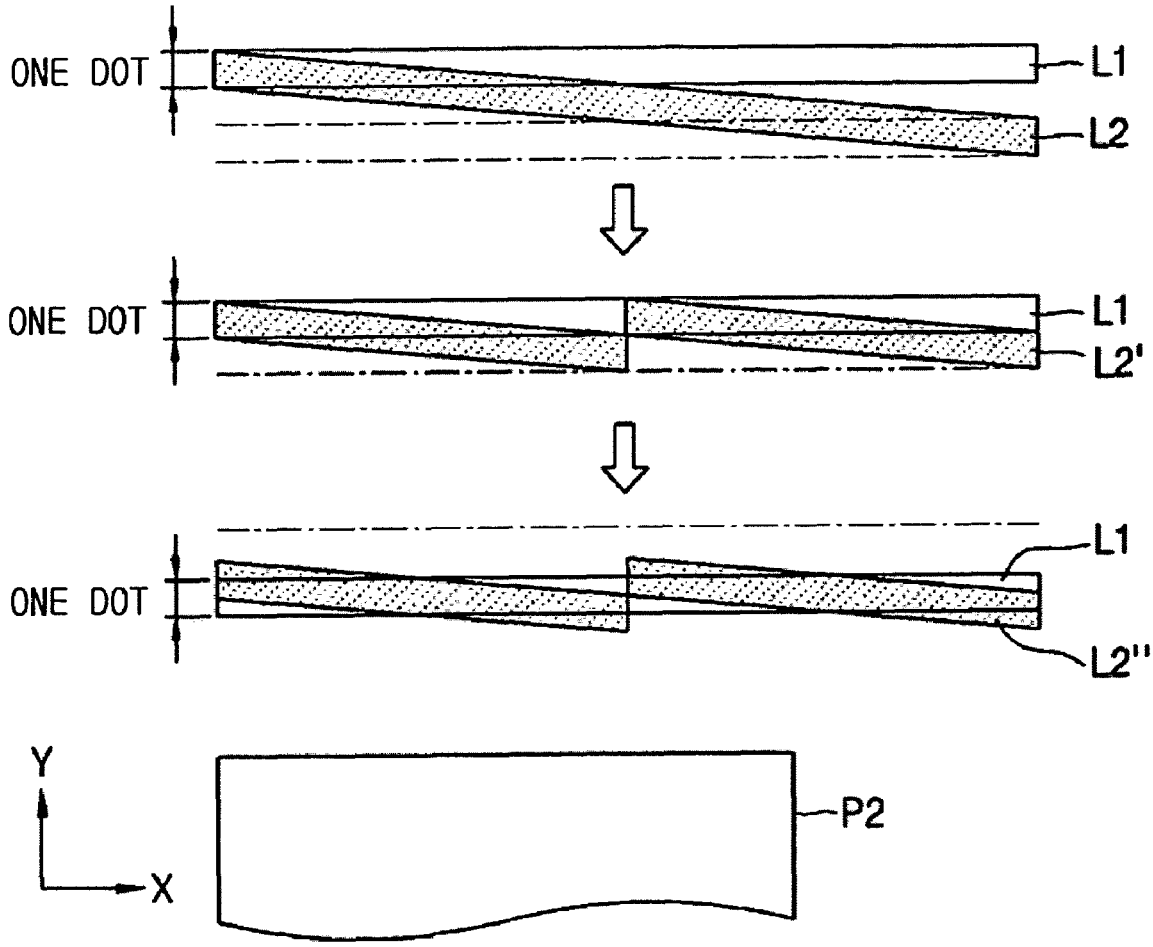

Referring to FIG. 9B, a descending skew of two dots occurs in the second scanning line L2 in comparison to the first scanning line L1. Since the size of the skew is not less than '1', the original image signal for the second scanning line L2 is modulated to a combined image signal. Specifically, since the size of the skew is not less than one dot, but, is less than three dots, the original image signal is divided into two areas. That is, the original image signal in the second area that follows the first area on the left side is arranged to ascend by one dot in the sub-scanning direction Y. Accordingly, at the right end of the optical scanning area, a skew of one dot occurs between the modulated second scanning line L2', that corresponds to the combined image signal as modulated above, and the first scanning line L1. Thus, the second optical scanner 169 is controlled to make the scanning light ascend by 0.5 dot in the sub-scanning direction Y. If the printing paper P2 is fed by the side feeding process in the skew-compensated color image forming device, the superimposition part of the first scanning line L1 and the finally compensated second scanning line L2" is larger than that obtained in the case in which no skew compensation is performed. Thus, the discontinuation caused by the area division of the scanning line occurs on a part other than the center part of the printing paper P2. Accordingly, the quality of the color image printed on the printing paper P2 is improved.

Figure 9C:
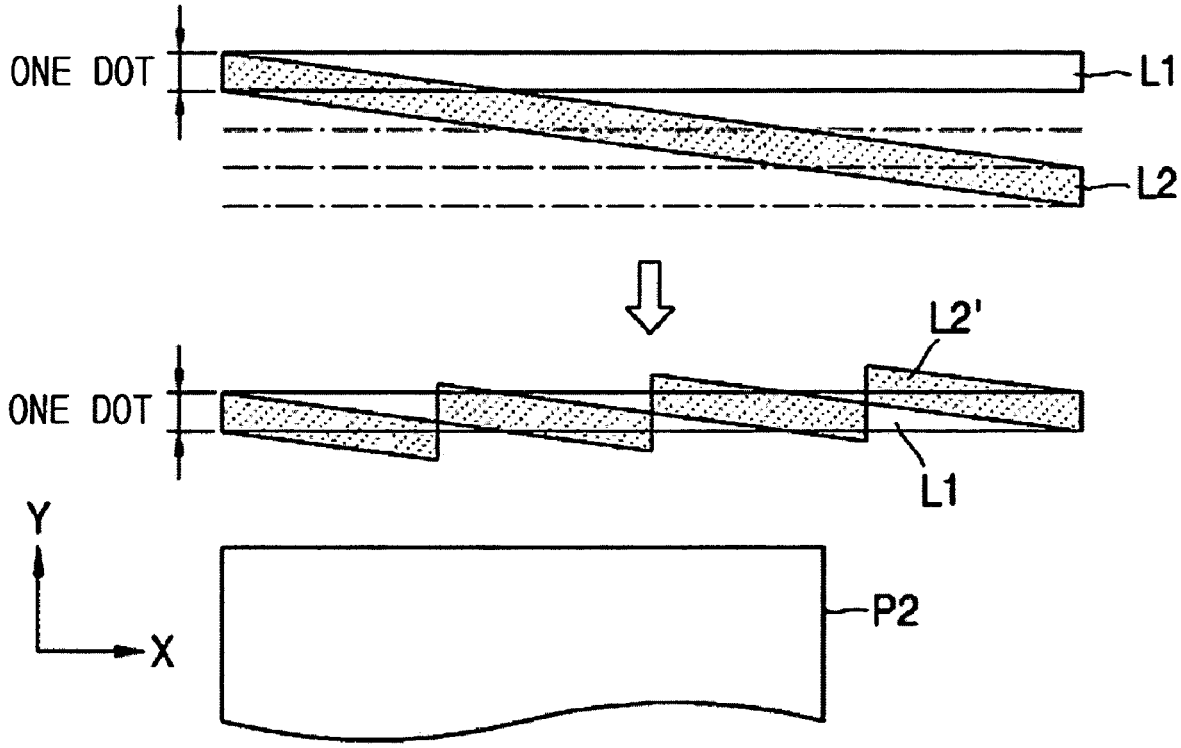

Referring to FIG. 9C, a descending skew of three dots occurs in the second scanning line L2 in comparison to the first scanning line L1. Since the size of the skew is not less than '1', the original image signal for the second scanning line L2 is modulated to a combined image signal. Specifically, since the size of the skew is not less than three dots, but, is less than five dots, the original image signal is divided into four areas. That is, the original image signal in the second area, that follows the first area on the left side, is arranged to ascend by one dot in the sub-scanning direction Y. Additionally, the original image signal in the third area is arranged to ascend by two dots in the sub-scanning direction Y and the original image signal in the fourth area is arranged to ascend by three dots in the sub-scanning direction Y. Accordingly, at the right end of the optical scanning area, no skew occurs between the modulated second scanning line L2', that corresponds to the combined image signal as modulated above, and the first scanning line L1. Thus, it is not required to control the second optical scanner 169 to make the scanning light ascend/descend by a specified length in the sub-scanning direction Y. If the printing paper P2 is fed by the side feeding process in the skew-compensated color image forming device, the superimposition part of the first scanning line L1 and the second scanning line L2' is larger than that obtained in the case in which no skew compensation is performed. Consequently, the discontinuation caused by the area division of the scanning line occurs on a part other than the center part of the printing paper P2. Accordingly, the quality of the color image printed on the printing paper P2 is improved.

Figure 9D:
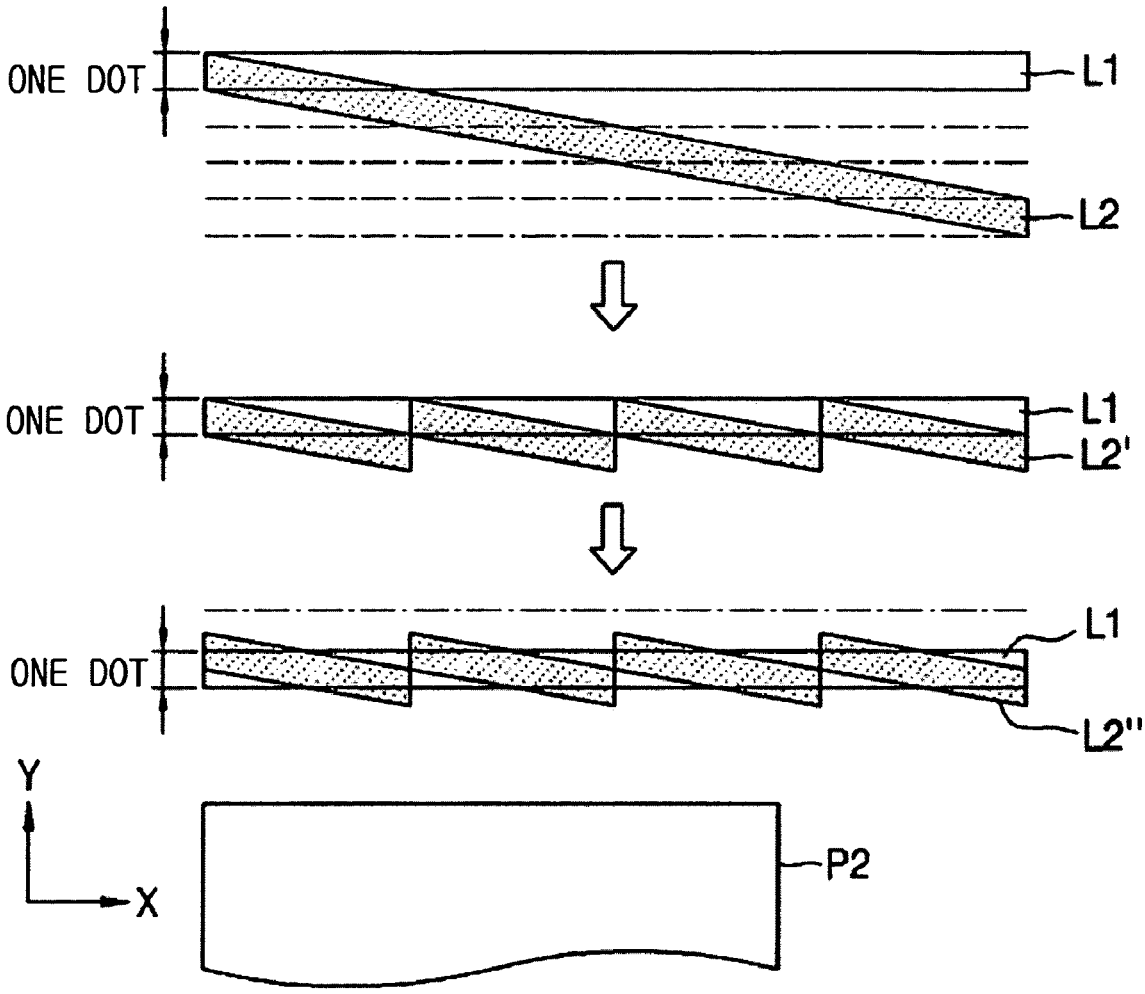

Referring to FIG. 9D, a descending skew of four dots occurs in the second scanning line L2 in comparison to the first scanning line L1. Since the size of the skew is not less than '1', the original image signal for the second scanning line L2 is modulated to a combined image signal. Specifically, since the size of the skew is not less than three dots, but, is less than five dots, the original image signal is divided into four areas. That is, the original image signal in the second area that follows the first area on the left side is arranged to ascend by one dot in the sub-scanning direction Y, the original image signal in the third area is arranged to ascend by two dots in the sub-scanning direction Y, and the original image signal in the fourth area is arranged to ascend by three dots in the sub-scanning direction Y. Accordingly, at the right end of the optical scanning area, a skew of one dot occurs between the modulated second scanning line L2', that corresponds to the combined image signal as modulated above, and the first scanning line L1. Thus, the second optical scanner 169 is controlled to make the scanning light ascend by 0.5 dot in the sub-scanning direction Y. If the printing paper P2 is fed by the side feeding process in the skew-compensated color image forming device, the superimposition part of the first scanning line L1 and the second scanning line L2' is larger than that obtained in the case in which no skew compensation is performed. Thus, the discontinuation caused by the area division of the scanning line occurs on a part other than the center part of the printing paper P2. Accordingly, the quality of the color image printed on the printing paper P2 is improved.

As described above, according to the skew compensation method and apparatus according to exemplary embodiments of the present invention, the skew occurring in the color image forming device can be compensated for by software. Particularly, by making the scanning line subject to compensation ascend/descend by a specified length in the sub-scanning direction, the superimposition part of the scanning line subject to compensation and a reference scanning line becomes larger than that obtained in the case in which no skew compensation is performed. Thus the quality of the printed image is improved.

Additionally, in the exemplary embodiments of the present invention, the discontinuation caused by the area division of the scanning line occurs on a part other than the center part of the printing paper to further improve the quality of the printed image.

While the invention has been shown and described with reference to certain embodiments thereof, it will be understood by those skilled in the art that various changes in form and details may be made therein without departing from the spirit and scope of the invention as defined by the appended claims.

What is claimed is:

1. A method for compensating for scanning skew 'S' occurring in an electrophotographic image forming device using a center feeding process, the method comprising the operations of:

dividing an area in which image forming is possible into a plurality of areas so that a center part of the area is not discontinued regardless of the number of dots of the scanning skew; and performing the image forming using image forming signals having different lines in accordance with the divided areas.

2. The method as claimed in claim 1, if the occurring skew 'S' is at least two dots, the area in which the image forming is possible is divided according to the following:

for $2n-1<S\leqq 2n+1$: dividing the area into 2n+1 areas;

wherein 'n' denotes a natural number.

3. The method as claimed in claim 2, wherein when the area in which the image forming is possible is divided into the plurality of areas, the center part of the area is determined to be wider than the other parts.

4. The method as claimed in claim 1, wherein when the image forming signals are transferred to the plurality of divided areas, the image forming signals having a difference of one dot in an upper/lower direction are transferred to the adjacent areas, respectively.

5. The method as claimed in claim 1, wherein the image forming device is a color laser printer.

6. A method for compensating for scanning skew occurring in an electrophotographic image forming device using a center feeding process, the method comprising the operations of:

dividing an area in which image forming is possible into a plurality of areas so that a center part of the area is not discontinued; and performing the image forming using image forming signals having different lines in accordance with the divided areas, wherein if the occurring skew is one dot, the skew is not compensated for.

7. An apparatus for compensating for scanning skew occurring in an electrophotographic image forming device using a center feeding process, the apparatus comprising:

an optical scanner control unit, dividing an area in which image forming is possible into a plurality of areas so that a center part of the area is not discontinued regardless of the number of dots of the scanning skew; and an image signal processing unit, which performs the image forming using image forming signals having different lines in accordance with by the divided areas.

8. The apparatus as claimed in claim 7, further comprising a skew measurement unit which measures whether the skew occurs according to a control command of the optical scanner control unit.

9. The apparatus as claimed in claim 7, wherein if the occurring skew is at least two dots, the optical scanner control unit divides the area in which the image forming is possible according to the following:

for $2n-1<S\leqq 2n+1$: dividing the area into $2n+1$ areas;

wherein 'n' denotes a natural number.

10. The apparatus as claimed in claim 9, wherein when the area in which the image forming is possible is divided into the plurality of areas, the optical scanner control unit determines the center part of the area to be wider than the other parts.

11. The apparatus as claimed in claim 7, wherein when the image forming signals are transferred to the plurality of divided areas, the image signal processing unit transfers the image forming signals having a difference of one dot in an upper/lower direction to the adjacent areas, respectively.

12. The apparatus as claimed in claim 7, wherein the image forming device is a color laser printer.

* * * * *